United States Patent [19]

Le Poole et al.

[11] Patent Number: 4,500,787

[45] Date of Patent: Feb. 19, 1985

[54] METHOD AND A DEVICE FOR FURNISHING AN ION STREAM

[75] Inventors: Jan B. Le Poole, Voorschoten; Pieter Kruit, Amsterdam, both of Netherlands

[73] Assignee: Nederlandse Centrale Organisatie Voor Toegepast Natuurwetenschappelijk Onderzoek, The Hague, Netherlands

[21] Appl. No.: 404,044

[22] Filed: Aug. 2, 1982

Related U.S. Application Data

[63] Continuation of Ser. No. 187,525, Sep. 15, 1980, abandoned.

[30] Foreign Application Priority Data

Sep. 17, 1979 [NL] Netherlands ..... 7906913

[51] Int. Cl.[3] ..... H01J 27/00

[52] U.S. Cl. ..... 250/427; 250/423 R

[58] Field of Search ..... 250/427, 423, 288, 492; 313/362, 363

[56] References Cited

U.S. PATENT DOCUMENTS

| | | | |
|---|---|---|---|
| 2,938,116 | 5/1960 | Benson et al. | 250/427 |
| 2,978,580 | 4/1961 | Ardenne | 250/427 |
| 3,505,518 | 4/1970 | Mitani | 250/399 |

OTHER PUBLICATIONS

"Diagnostics of the Flowing Afterglow" by Fohsenfield, *Int. Jour. of Mass Spectrometry and Ion Physics,* 16, Nos. 1 and 2 (1975), pp. 151–166.

"High Luminosity Ion Source for Mass Spectrometers" by Sysoew et al., *Soviet Physics–Tech. Physics,* 23, No. 6, Jun. 1978, pp. 714–718.

*Primary Examiner*—Bruce C. Anderson

*Attorney, Agent, or Firm*—Hammond & Littell, Weissenberger & Dippert

[57] ABSTRACT

Method and device for furnishing an ion stream by causing gas to flow through a discharge aperture having a diameter of at most 20 μm into an evacuated chamber and ionizing said gas by means of one or a plurality of focused electron beams downstream of said aperture in which the ionization is effected immediately downstream of said discharge aperture.

8 Claims, 1 Drawing Figure

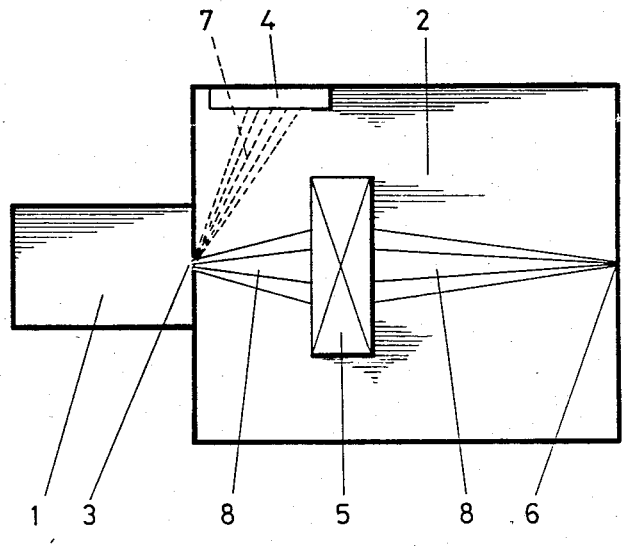
7
4
2
1
3
8
5
8
6

METHOD AND A DEVICE FOR FURNISHING AN ION STREAM

This is a continuation of Ser. No. 187,525, filed Sept. 15, 1980 abandoned.

The invention relates to a method for furnishing an ion stream by causing a gas to flow through a discharge aperture having a diameter of at most 20 μm into an evacuated chamber and ionizing said gas by means of one or a plurality of focused electron beams downstream of said aperture. Furthermore the invention relates to a device for performing the above method.

A similar method and device are known from an article by T. D. Märk et al., entitled "A simple bakeable hollow cathode device for the direct study of plasma constituents" published in "The Review of Scientific Instruments", Vol 43, No. 12, December 1972, pages 1852–1853. In this article it has been suggested to cause the discharge of a gas to be analyzed in a mass spectrometer through a aperture provided in a molybdenum disc and having a diameter of 20 μm. Upstream of the said disc provided with said discharge aperture and insulated therefrom there are provided two annular electrodes over which a potential may be impressed in order to partially ionize the gas flowing therebetween. Downstream of said disc provided with said discharge aperture there is provided a grid of conducting material on which a voltage may be impressed for influencing the velocity of the charged particles discharged through said discharge aperture. The device described in the above mentioned article is furthermore provided with means for generating one or a plurality of electron beams, said beam(s) being focused at a location downstream of said grid while ionizing the gas stream passed through said grid at that location. The ion stream thus obtained is conducted to a mass spectrometer in which an analysis of the ions is effected.

The object of the invention is to provide an ion stream having a high radiance and a narrow energy distribution (at most some electronvolts). The radiance of an ion stream comparable with the radiancy in light optics is the current per unit of area and per unit of spherical angle. The radiance may be described by the formula $$R = I/(S\Omega)$$

in which:

I = the current (ampère)

S = the surface area ($cm^2$)

Ω = spherical angle (radian).

The invention is based on the conception that an ion stream having a high radiance may be obtained upon ionizing a dense gas flow within a very small area by means of an electron beam having a high current density.

The method and the device described in the above discussed article by Märk et al. concern indeed the furnishing of an ion stream by ionizing a gas stream with the aid of an electron beam, but they are not suitable for furnishing an ion stream having a high radiance. In the described device the gas stream discharged from the discharge aperture passes first a grid and is only ionized thereupon. Where the discharged gas stream has a conical shape the diameter thereof downstram of the grid, i.e. at the location where the ionization is effected will already be considerably large than immediately downstream of the discharge aperture per se. Hence the area of ionization will not be very small and the imparted radiance will consequently not be very high.

A high radiance may however be imparted indeed when ionizting the gas stream at the location where the diameter of the stream is the smallest, i.e. immediately downstream of the discharge aperture. Such an ionization is possible if the grid is omitted. Moreover the electrodes upstream of the discharge aperture may likewise be omitted because it is not necessary and even undesirable to ionize part of the gas already before the discharge thereof.

The said object of the invention, i.e. the furnishing of an ion stream having a high radiance and a narrow energy distribution may thus be obtained by a method of the above mentioned type, said method according to the invention being characterized in that the ionization is effected immediately downstream of said discharge aperture.

Furthermore the object of the invention is attained by means of a device for furnishing an ion stream, said device comprising a first chamber to which gas may be supplied or in which vapor may be produced and a second chamber which may be evacuated, a wall separating said first chamber from said second chamber and possessing a discharge aperture having a diameter of at most 20 μm and means for generating one or a plurality of electron beams focused in said second chamber, characterized in that the focus of said electron beam(s) is located in the immediate vicinity of said discharge aperture.

Due to plasma and space charge effects the radiance of an ion stream furnished in accordance with the invention increases when the region in which the ionization is effected becomes smaller, i.e. when the diameter of the gas stream becomes smaller. This may be attained by imparting a very small diameter to the discharge aperture. An extremely small discharge aperture will however also result in a very slight flow, this being undesirable. It has been demonstrated experimentally that optimal circumstances may be obtained by applying a discharge aperture having a diameter smaller than 10 μm, for instance a diameter of 5 μm.

For obtaining a sufficiently high radiance it is required that there is created a relatively high pressure differential across the discharge aperture. It has been demonstrated experimentally that results may be obtained by applying a pressure differential in the order of magnitude of some tenths of a bar, for instance 0.2 bar.

For ionizing the gas stream immediately downstream of the discharge aperture use may be made of one strongly focused electron beam, though also a plurality of electron beams may be applied all said beams being directed on to the gas stream immediately downstream of the discharge aperture. The ionization of the gas stream by means of one or more electron beams is accompanied by a luminous effect. This luminous effect may be utilized for adjusting the electron beam(s). In as much as the generated ions have to be removed by means of a rather strong electric field the electron beam should have small dimensions in the axial direction in order to keep ΔE small. Consequently it is important to produce an electron beam having a high current density.

According to a special embodiment of the invention use is made of a discharge aperture provided in a platinum foil forming one of the walls of a relatively small vessel. This small vessel (some $cm^3$) may easily be heated whereby it is feasible to evaporate normally solid substances, like for instance sodium chloride and to cause the discharge thereof in a gaseous condition through the discharge aperture.

If an ion stream I possesses a high radiance and a narrow energy distribution this stream I may be focused by means of electrostatic or magnetic lenses in a smaller region than would be possible in case of an ion stream having a lower radiance. Stated otherwise the dispersing effect caused on an ion stream to be focused by faults of an electrostatic or magnetic lens will be smaller as the radiance of the stream to be focused is higher and the energy distribution thereof is narrower.

Hence it becomes possible by the method of the invention to furnish a very narrow ion beam having a relatively high current by means of electrostatic or magnetic lenses whereby the ions may be concentrated in a very small area. Such a narrow ion beam may be utilized for selectively implanting ions, i.e. implanting ions at predetermined locations of a surface or for removing material by etching by means of ions without requiring a template so that the production steps for applying a template are eliminated. Such a narrow ion beam may also be used for selectively radiating a radiation sensitive masking material. It has been found that many radiation sensitive materials have an appreciable higher sensitivity for ions than for electrons. Where the applied ion beam is very narrow and where due to the greater mass of ions the dispersion of ions is appreciably less than that of electrons one may obtain an abrupt transition between treated and not-treated areas which may for instance be of much importance in the fabrication of micro-electronic parts.

The FIGURE shows a cross-section of one device for the practice of the method and device of the invention.

1 is a container for the gas to be ionized.
2 is the evacuated ionizing chamber.
3 is the small aperture.
4 is an electron gun.
5 is an electrostatic or magnetic ion lens.
6 is the spot on which the ion beam is focused.
7 is the electron beam.
8 is the ion beam.

We claim:

1. A method for furnishing an ion stream by causing gas to flow through a discharge aperture having a diameter of at most 20 μm into an evacuated chamber and ionizing said gas by means of one or a plurality of focused electron beams downstream of said aperture characterized in that the ionization is effected at the location where the diameter of the gas stream is the smallest immediately downstream of said discharge aperture.

2. The method according to claim 1 characterized in that the discharge aperture has a diameter of less than 10 μm.

3. The method according to claims 1 or 2 characterized in that upstream of said discharge aperture the pressure of the gas is in the order of magnitude of $10^{-1}$ bar.

4. A device for furnishing an ion stream, said device comprising a first chamber to which gas may be supplied and a second chamber which may be evacuated, a wall separating said first chamber from said second chamber and possessing a discharge aperture having a diameter of at most 20 μm and means for generating one or a plurality of electron beams focused in said second chamber characterized in that the focus of said electron beam(s) is located in the immediate vicinity of said discharge aperture where the diameter of the gas stream is the smallest.

5. The device according to claim 4 characterized in that the discharge aperture has a diameter of less than 10 μm.

6. A method for selectively implanting ions in which an ion stream is concentrated in a very small area of the surface of the piece of work to be treated by means of lenses selected from the group consisting of electrostatic lenses, magnetic lenses or mixtures thereof, the improvement consisting essentially of utilizing an ion stream produced by the method of claims 1 or 2.

7. A method for etching with the aid of ions in which an ion stream is concentrated in a very small area of the surface of the piece of work to be treated by means of lenses selected from the group consisting of electrostatic lenses, magnetic lenses or mixtures thereof, the improvement consisting essentially of utilizing an ion stream produced by the method of claims 1 or 2.

8. A method for radiating sensitive material with ions in which an ion stream is concentrated in a very small area of the surface of the piece of work to be treated by means of lenses selected from the group consisting of electrostatic lenses, magnetic lenses or mixtures thereof, the improvement consisting essentially of utilizing an ion stream produced by the method of claims 1 or 2.

* * * * *